US008898998B1

(12) United States Patent
Triglia, Jr.

(10) Patent No.: US 8,898,998 B1
(45) **Date of Patent: *Dec. 2, 2014**

(54) METHOD TO MANUFACTURE PANELING OR FLOORING STRIPS FROM WOODEN BARREL STAVES

(76) Inventor: Joseph P. Triglia, Jr., West Islip, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/453,256

(22) Filed: Apr. 23, 2012

Related U.S. Application Data

(62) Division of application No. 12/313,212, filed on Nov. 17, 2008, now Pat. No. 8,181,408.

(51) Int. Cl.

| | |
|---|---|
| ***B44F 9/00*** | (2006.01) |
| ***E04B 1/10*** | (2006.01) |
| ***E04F 13/10*** | (2006.01) |
| ***E04F 15/04*** | (2006.01) |

(52) U.S. Cl.
USPC ..... 52/745.19; 52/745.2; 52/747.1; 52/311.2; 52/223.6; 52/223.7

(58) Field of Classification Search
USPC ..... 52/745.2, 747.1, 223.6, 223.7, 311.1, 52/311.2, 311.3, 313, 745.15–745.19; 428/53–54, 106, 114, 537.5, 0.1, 906, 428/81, 573.1
See application file for complete search history.

(56) References Cited

U.S. PATENT DOCUMENTS

| | | | | |
|---|---|---|---|---|
| 2,361,639 | A * | 10/1944 | Loughborough | 162/27 |
| 2,503,443 | A * | 4/1950 | Knapp | 427/205 |
| 3,067,456 | A * | 12/1962 | Himmelheber et al. | 425/217 |
| 3,682,675 | A * | 8/1972 | Myers | 427/270 |
| 6,898,834 | B1 * | 5/2005 | Warren | 29/403.1 |
| 7,527,865 | B2 * | 5/2009 | Kessing | 428/423.3 |
| 2003/0060113 | A1 * | 3/2003 | Christie et al. | 442/364 |

OTHER PUBLICATIONS

Hunt, et al.,"Development of New Microwave-Drying and Straightening Technology for Low-Value Curved Timber"; Department of Agriculture; pp. 1-5; May 2005.

* cited by examiner

*Primary Examiner* — Jeanette E. Chapman
(74) *Attorney, Agent, or Firm* — Hoffman & Baron, LLP

(57) ABSTRACT

Disclosed is a novel wall or ceiling paneling or flooring manufactured from curved cask staves used in the aging of liquors, including wine and whiskey, having a desirable patina that emits a scent having a bouquet associated with the bouquet of the fermented liquor that was aged in the cask, as well as a method to manufacture the paneling or flooring that includes the steps of first straightening the curved staves, and then scrapping a portion of the stained surface layer of the stave to remove any splintering that may have occurred during the stave straightening process. The straightened, scraped stave is affixed to a wall or predetermined sub flooring surface with the stained surface layer remaining exposed for viewing or foot traffic and to permit the release of the wine, whiskey or other spirit bouquet into the room.

12 Claims, 2 Drawing Sheets

METHOD TO MANUFACTURE PANELING OR FLOORING STRIPS FROM WOODEN BARREL STAVES

BACKGROUND OF THE INVENTION

1. Field of the Invention

This invention relates in general to novel paneling or flooring strips and to a method for manufacturing these paneling or flooring strips, and more particularly to paneling or flooring strips constructed from used cask staves used to age liquor, such as wine, whiskey and other spirits.

2. Prior Art

With environmental concerns at the forefront many attempts are being made to recycle various products. One such product is the cask used to age wines, whiskeys and other spirits. Each year a hundred thousand or more of such casks reach the end of their useful life and are discarded. Attempts to find uses for these discarded wine and whiskey casks are being driven not only by environmental concerns, but also economic interests. These casks are typically constructed from premium clear French and American oak, most often taken from mature, old-growth trees, many of which are 100 to 150 years old. Environmentally, it would be very desirable to find new uses for these discarded casks. Economically, the costs of such premium wood makes it highly desirable to re-coup as much salvage value as possible when the cask can no longer be used to age wine, whiskey or other spirits.

Oak is by far the most used wood in the construction of these casks. However, of the hundreds of oak species, there are only three species used in the production of a substantial majority of the wine and whiskey casks: *Quercus Alba, Quercus Petraea*, and *Quercus Robur*. These particular species are utilized because of their unique physical and chemical nature. They possess physical strength due to their wide radial ray, tightness of their rings, as well as do not possess resin canals (such as pine or rubber trees) that can impart undesirable flavors to the wine or whiskey. Still further, as a result of the seasoning and heating treatments common during the coppering process, these oaks will produce from the hemicellulose, lignin, oak tannins and oak lactones making up the oak: wood sugars that add body to the wine or whiskey; toasty and caramelized aromas and flavors; color; sweet, smoky and spice aromas; other delicate fragrances; as well as woody and coconut characters. The individual staves are manufactured by first stripping the bark from the oak log and then quarter splitting or quarter sawing the oak log. The staves are next dried, generally by kiln drying, or more preferably by air drying. The dried staves are arranged inside a metal hoop and then heated in stages (warming up or pre-chauffrage, shaping or cintrage, and toasting or bousinage) to achieve the desired bent shape to form the cask. An example of a typical finished barrel is illustrated in FIG. 1. Cask sizes can vary, but casks used in the aging of wine, whiskey and other spirits typically hold 50-132 gallons. Depending on the cask size, the cask or barrique may also be referred to as a barrel, a hogshead, or a butt. As used herein, "cask" is used generically to refer to all sizes.

In addition to impart desirable wine making characteristics, the oak cask staves must be constructed to handle the load of the wine when the casks are stacked in storage during the aging process. During the aging process, the wine obtains a suitable amount of oxygen through the pores of the oak to aid in the maturing of the wine and to extract any tannin from the oak staves aid in obtaining the desired taste. For this reason the thickness of oak staves is limited in order to permit adequate oxygen passage through the wood pores to the wine.

However, over time the amount of tannin received by the wine from inside of the wood pores is detrimentally decreased eventually requiring replacement of the casks. To prolong the current life of a cask they are generally re-used. This is achieved by scrapping or shaving (with and without toasting of the cask) the interior of the cask to expose non-wine, whiskey or other spirit impregnated oak to the wine, whiskey or other spirit to permit continued flavoring or conditioning of wine or whiskey. However, even with this re-conditioning, traditional oak casks are generally used only about 2 or 3 times before they require replacement.

Because of the coloration and condition of the inner layer of the stave due to up to 30 years of contact and chemical interaction with the wine, whiskey or other spirit, dehydrated wine residue or wine-stone from the aging process in a discarded wine cask, there has been little demand for these discarded casks. The most common use of discarded wine and whiskey casks is to saw them in half and use the top and bottom halves as wooden planters for flowers and small shrubs. Such use generally permits recovering of no more than about 1%-2% of the original cost of the cask.

More recently, companies have begun offering for sale furniture made from recovered staves. In addition one company now offers flooring strips made from wine cask staves. In this case the wine cask staves are straightened by a non-disclosed proprietary process, the stained layer of each straightened stave is then milled away to produce a flooring strip of desired thickness. When the strip is used as flooring the milled surface is affixed to the sub flooring with the non-stained layer of the staves exposed for foot traffic. Because of the process needed to convert the staves to useful flooring strips is expensive, such converted staves can not effectively compete against conventional oak flooring strips. To overcome this marketing disadvantage these strips are touted for the logos and winery identification markings found on the non-stained exterior surface of the cask. However, because only a few of the staves on each cask have such markings, either the flooring must have a limited number of such markings or a large number of staves must be treated to obtain the desirable strips. These flooring strips have met with only limited commercial success. Therefore, there is still a need in the wine and spirits industry to find other ways to use the discarded casks that also permit larger recovery of the initial cask costs.

OBJECTS AND SUMMARY OF THE INVENTION

Therefore, one object of this invention is to provide uses for a discarded wine or whiskey cask that permit greater recapture of the initial capital investment in the cask.

Another object of this invention is to provide a novel paneling or flooring strip having one surface layer possessing both a unique coloration and patina resulting from the cooper hand scrapping of the interior cask surface and from the soaking this surface layer for up to 30 years with a spirit or wine.

A further object of this invention is to provide a novel oak wall or ceiling paneling or flooring strip manufactured from a cask stave that emits a scent having a bouquet of similar characteristics as the spirit or wine aged in the cask.

A still further object of this invention is to provide an improved method for manufacturing wall or ceiling paneling or flooring strips with unique colorations and patina resulting from the hand scrapping of the interior surface of the cask and from being stained from prolonged contact with a spirit or wine.

A still further object of this invention is to provide an environmentally friendly method for manufacturing oak paneling or flooring strips from discarded wine or whiskey cask staves emitting a scent having a bouquet with similar characteristics of the wine or whiskey that was aged in the cask.

Other objects and advantages of this invention shall become apparent from the ensuing descriptions of the invention.

Accordingly, this invention in one embodiment is a novel elongated wooden paneling or flooring strip having a top surface layer that will be exposed when it is affixed to the sub flooring material. This top surface is first stained from contact with a spirit or wine for a period of up to 30 years. The stained surface layer which is typically 3/16 inch to ½ inch thick is scraped or shaved, preferably by hand, to remove any splintering that might occur during the stave straightening process and to remove at least some of the upper layer of the stained surface to expose the lower layer of the stained surface resulting in the strip releasing over time a scent bouquet having characteristics of the spirit or wine that had been aged in the cask.

In an alternate embodiment the invention includes a method of converting curved wine or whiskey cask staves to novel straight wall or ceiling paneling or flooring strips. In the first step the curved staves are straightened. A preferred method for straightening the curved staves includes soaking the curved staves in water for a period of time to render the staves sufficiently pliable to minimize splitting or checking when the staves are pressed flat. In a preferred embodiment the staves are soaked for a period of 2-4 days. The soaked staves are then pressed flat and steam treated for at least 30 minutes at least 110° C., preferably 30-45 minutes at 110° C.-120° C. The pressed and steam treated staves are then kiln dried under conditions to achieve a reduction in the water content of the stave to 10% by weight or less. In a preferred embodiment the kiln drying is achieved by circulating heated air over the stacked staves. In a preferred embodiment, the air is heated to 30° C. to 90° C. This drying process typically takes at least 20 days depending on humidity and other weather factors. The top layer of the stained surface of the dried stave is then scraped or shaved to smooth and better expose the layer of the stained surface resulting in an enhancement of the wine or spirit bouquet emanating from the stave.

In an alternate embodiment the curved barrel staves can be dried and straightened by the use of microwaves and pressing. In this alternate process the cask stave may be, but does not have to be pressure soaked with water before being subjected to microwave heating. If the pressure soaking step is utilized it is preferred that the pressure soaking will be conducted under conditions that will bring the moisture content of the barrel stave to near fully saturated conditions. The cask stave is subjected to microwave treatment to heat the cask stave to a temperature in the range of 90° C. to 150° C. and then pressing the heated board for a period of time between five seconds and 15 minutes. It is preferred to hold the cask stave temperature in the range of 90° C. to 150° C. for a period of time before applying two-dimensional pressure. This period of time is preferably set to permit thermally plasticize various wood components, such as lignin and hemicellulose, causing these components to soften and flow. A period of time of about 10 minutes is most preferred. In another preferred embodiment the microwave heating is continued after the two-dimensional pressure is applied to the cask stave. After the microwave heating is discontinued the cask stave is maintained under pressure as the cask stave cools. This period of time should be sufficient to permit the plasticized wood components to harden into the desired straightened shape.

A further embodiment of this invention is the utilization of the straightened and scraped or shaved strip as a wall or ceiling paneling or flooring surface. In this embodiment the non-stained surface layer of the strip is milled to achieve the desired wall or ceiling paneling or flooring thickness. The milled strip is then affixed to the wall, or ceiling, or to the sub-flooring with the stained surface layer exposed for viewing or foot traffic. If it is desired to suppress the scent bouquet, then the exposed stained surface may be sealed with any known sealant. However, to retain the unique coloration and patina resulting from the contact of the stave with the wine or whiskey during the aging process, it is preferred to use a clear sealant, and more preferably to use a non-VOC emitting sealant such as tung oil.

PREFERRED EMBODIMENTS OF THE INVENTION

Both the novel wooden strips, as well as the method for manufacturing and assembling the novel wooden flooring could originate from the use of standard straight planks that have been soaked in any fermented liquid for a prolonged period. However, the preferred embodiments of this invention will be described with reference to the utilization of staves from a discarded wine cask.

Figure 1:
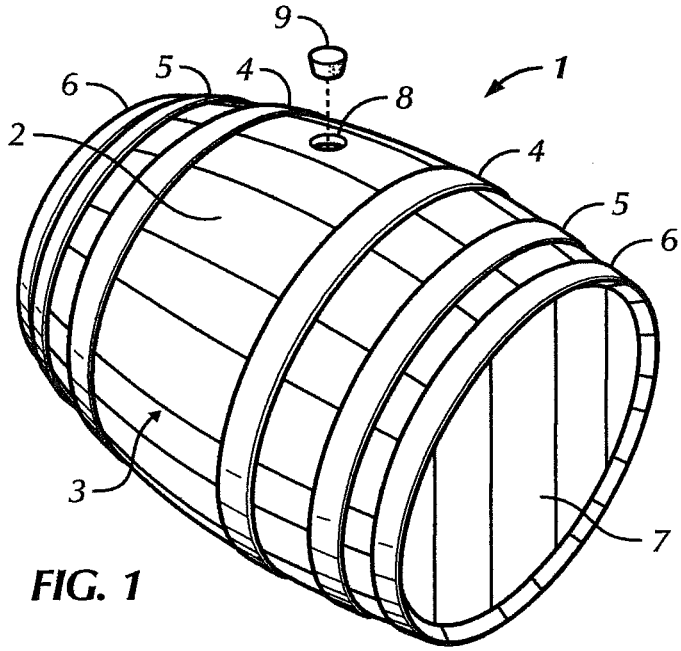
FIG. 1 is a perspective view of a typical wine cask used for aging wine.
Figure 2:
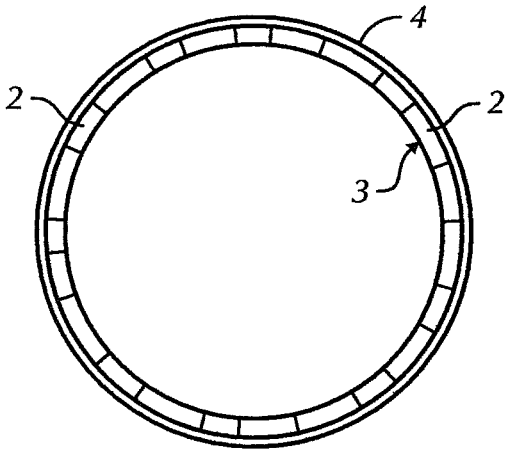
FIG. 2 is a top view of the staves initially positioned before bending by the cooper during the cask making process.

FIG. 1 depicts a typical wine cask 1 assembled with staves 2. These staves 2 may be formed by any of the well known cooperage methods. In a typical process staves 2 will be cut into a predetermined shape and size and then allowed to air dry for 24-36 months to season the wood; i.e., reduce tannic astringency, as well as release more vanillin. In a typical wine cask about 30-36 staves will be used. Because of the quality demanded normally only 2-3 casks will be built from a single 160-250 year old oak tree. A cooper will take the straight staves 2 and assembly them by fitting them together to form a circumferential wall 3 (see FIG. 2). The staves are held in this position by metal bilge hoops 4. While in this position the partially assembled cask will be heated to soften the staves 2 and increase the flexibility of the staves 2 so that they can be bent in the desired shape and held in that position by quarter hoops 5. Typically, an open flame or steam is used to heat the staves 2. The casl then undergoes a second toasting to further soften the staves 2 so that they can be further bent and head hoops 6 can be hammered into place at the ends of the cask 1 to achieve the final desired shape, such as illustrated in FIG. 1. Wooden end panels or heads 7 at each end of the assembled curved staves 2 form the remainder of the cask 1. To permit the introduction and removal of the wine that will be aged in cask 1 one of staves 2 will be provided with a bung hole 8 that can be sealed by bung 9 being inserted in the bung hole 8.

In the wine making process, the pressed grape juice, typically with a fermenting agent such as yeast are placed in cask 1. The yeast cells excrete enzymes that convert the natural fruit sugars into alcohol and carbonic gas. This conversion continues until either the sugar has been used up or the level of alcohol reaches a point that it is toxic for the yeast enzymes. However, under modern methods the amount of fermentation can be controlled through the use of heat, introduction of sulfur dioxide or alcohol or carbonic gas, centrifugal filtration, or pressurization of the barrel. If desired flavoring agents may also be placed in cask 1 during the fermentation process. During this process cask 1 is typically sealed with bung 9. During the second phase of fermentation, known as malolactic fermentation, bacteria can be introduced that converts the "hard" malic acid of unripe grapes into t "soft" malic acid and carbonic gas. After fermentation, the wine remains in the cask 1 to age. During the 2-5 years of aging the wine interacts with the oak wood to receive tannins extracted from the wood. In addition, due to variations of temperature and of atmospheric pressure air is introduced into the cask resulting in the production of wine of desired taste, bouquet, and mouth feel. Because of the formation of wine-stone on the inner surface of the staves 2 and the leaching of the tannins from the inner oak layer penetrated by the wine, it is necessary to recondition the cask by scrapping the inner surface to expose new oak to the wine. This reconditioning process can only be done a limited number of times before the cask 1 is no longer suitable for aging wine.

Figure 3:
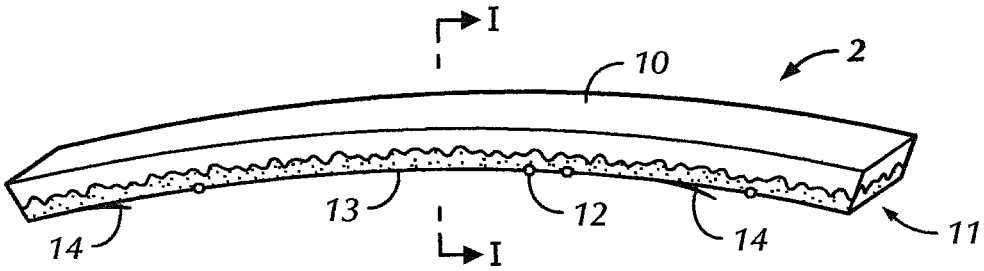
FIG. 3 is a side view of an individual stave removed from the FIG. 1 wine cask.
Figure 4:
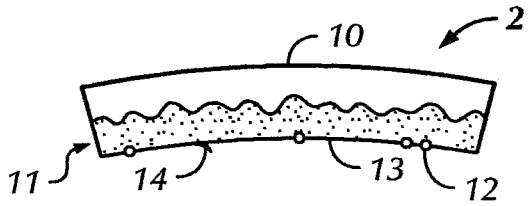
FIG. 4 is a cross-sectional view of the stave of FIG. 3 taken along lines I-I.
Figure 5:
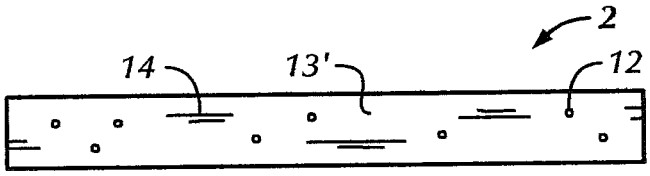
FIG. 5 is a bottom view of an individual stave of FIG. 3.

Referring now to FIGS. 3-5, the used stave 2 of a discarded cask 1 has an outer surface layer 10 and an inner surface layer 11 that may be up to ¼ to ½ inches thick. As a result of the fermentation and aging process only the inner surface layer 11 has been discolored by the wine during the aging process. In addition dehydrated wine residue will remain trapped within this inner surface layer 11. In addition there may be wine-stone 12 adhered to the outer surface 13 of layer 11. This outer surface 13 may also comprise wood splinters 14 or other imperfections resulting from the scrapping or shaving done during the reconditioning of cask 1. If the wine cask 1 underwent heavy toasting during the seasoning of cask 1 or during the recondition of cask 1, then the outer surface of layer 11 may also be charred. As a result the condition of layer 11 has, until this invention, been considered undesirable.

Because of the initial bending processing of stave 2, its seasoning once incorporated into a wine cask, and its further conditioning through the 30 years of constant chemical and physical interaction with the wine stored in the cask, there was no known way to straighten and otherwise condition staves 2 that permitted the use of stained layer 11 for flooring having the patina, coloration and character of the original interior surface of the seasoned stave 2 or for use as a wall or ceiling plank that emits a bouquet reminiscent to the bouquet of the wine that had been stored in the cask 1.

In addition during the wine aging process the outer surface layer 9 will have lost moisture content making the stave 2 a wood strip that can not be easily straightened by publicly known methods without checking or splitting of the stave 2. Staves 2 can be straightened by first soaking the staves in water until they are sufficiently pliable to permit straightening with minimum checking or splintering of the strip; i.e., less than a 10% of the surface area needs to be hand scraped to remove any splintering and to smooth the surface. It is preferred that staves 2 be soaked for a period of 2-4 days, and more preferably about 3 days. Next, using a hydraulic press the water soaked staves 2 are pressed into a straight profile while at the same time subjecting the staves 2 to a steam bath. It is preferred that the staves 2 are maintained in this condition for at least 30 minutes and the steam is maintained at least about 110° C. More preferably, the staves 2 are maintained in the straight profile position by the press for 30-45 minutes and the steam is maintained between 110° C. and 120° C. After this treatment, the staves 2 are kiln dried utilizing heated air circulating about the staves 2 until the moisture content of the staves 2 is reduced to 10% by weight or less. It is preferred that the heated air maintained between 30° C. and 90° C. be circulated about the staves 2 for at least 20 days depending on humidity and other weather factors.

In an alternate embodiment the curved cask staves 2 can be dried and straightened by the use of microwaves and pressing. In this alternate process the cask stave 2 may be, but does not have to be pressure soaked with water before being subjected to microwave heating. If the pressure soaking step is utilized, it is preferred that the pressure soaking will be conducted under conditions that will bring the moisture content of the cask stave 2 to near fully saturated conditions. The cask stave 2 is placed in a microwave oven and subjected to microwave treatment to heat the cask stave 2 to a temperature in the range of 90° C. to 150° C. and then pressing the heated stave 2 for a period of time between five seconds and 15 minutes. It is preferred to hold the cask stave 2 temperature in the range of 90° C. to 150° C. for a period of time before applying two-dimensional pressure by a press that is preferably positioned within the microwave oven. This period of time is preferably set to permit thermally plasticization of various wood components, such as lignin and hemicellulose. This plasticization will cause these components to soften and flow and allow the stave 2 to become more pliable. A period of time of about 10 minutes is most preferred. In another preferred embodiment the microwave heating is continued after the two-dimensional pressure is applied to the casl stave 2. After the microwave heating is discontinued the barrel stave 2 is maintained under pressure as the cask stave 2 cools. This period of time should be sufficient to permit the plasticized wood components to harden into the desired straightened shape.

If the kiln dried stave 2 is to be used as flooring, then the outer surface of stained layer 11 of the kiln dried stave 2 is next scraped or shaved to remove the wine-stone, charred surface and any splinters that may be in the surface. It is preferred that the scrapping or shaving be done by hand to maintain the integrity of the original barrel interior stained wall surface. Even if not being used as flooring, but being used as a wall or ceiling plank, it is also preferred that a sufficient amount of the outer surface layer be removed to create at least a partial new skin or surface 13' of the stained layer 11. The amount of new skin or surface 13' that is created can control the strength of the wine bouquet detected.

The novel strips created by the above described process can then be used as wall or ceiling paneling or flooring. In these uses the non-stained surface layer 10 is milled to provide a strip of desired thickness. This step preserves the unique coloration and patina, as well as wine-like bouquet of the stained surface layer 11. In the case of a cask that has been used to age red wine an accenting of the wood grain is achieved, along with a muted purplish hue in those exposed sections that were discolored by the wine. In addition, this novel coloration achieves a patina similar to that found on antique furniture. As a result of this invention, a very expensive paneling or flooring product is created that permits recouping a larger percentage of the initial cost of the wine cask.

If one does not desire the wine bouquet effect, then the outer surface 13' of the stained layer 11 can be sealed with any known wood sealant, preferably a clear sealant that retains the unique coloration and patina of the strip. More preferably, a sealant selected should be one that does not release volatile organic compounds when used. One example of such a sealant is tung oil.

What I claim is:

1. A method of manufacturing a wood panel for flooring or paneling from a wood stave of a discarded barrel used for fermentation of contents stored therein, the wood stave having a curved profile, a stained surface layer corresponding to an interior of the discarded barrel, the stained surface layer having a thickness defined by a coloration throughout the thickness from the fermentation of the contents stored therein, and an opposing non-stained surface layer corresponding to an exterior of the discarded barrel, the method comprising:

straightening the wood stave from the curved profile into a straightened profile suitable for flooring or paneling comprising pressing the wood stave between the stained surface layer and the opposing non-stained surface layer; and smoothing the outer surface of the stained surface layer of the wood stave, the smoothed outer surface forming an outer exposed surface of the wood panel for flooring or paneling comprising the coloration from the fermentation.

2. The method of claim 1, wherein smoothing the outer surface further comprises removing splinters formed from pressing the wood stave and removing a sufficient portion of the stained surface layer to release a scent bouquet.

3. The method of claim 1, wherein straightening the wood stave further comprises soaking the wood stave in water for a period of time to render the wood stave pliable prior to pressing into the straightened profile.

4. The method of claim 1, further comprising steam treating the wood stave at a temperature of at least 100° C. while pressing the wood stave into the straightened profile.

5. The method of claim 4, further comprising steam treating the wood stave for at least 30 minutes at the temperature of at least 100° C.

6. The method of claim 4, further comprising kiln drying the wood stave after straightening.

7. The method of claim 6, further comprising kiln drying the wood stave under conditions to achieve a reduction in the water content of the stave to less than 10% by weight.

8. The method of claim 1, wherein straightening the wood stave further comprises heating the wood stave by microwaving the wood stave to a temperature in the range of 90° C. to 150° C. prior to pressing, the heating being continued for a sufficient period of time to plasticize lignin and hemicellulose components of the wood stave, and cooling the wood stave while pressing for a period of time sufficient to achieve hardening of the plasticized components.

9. A wood panel for flooring or paneling manufactured in accordance with the process of claim 1.

10. The wood panel for flooring or paneling according to claim 9, wherein the contents stored therein include wine, whiskey or other spirit.

11. The method of claim 6, further comprising circulating heated air about the wood stave to achieve a reduction in water content of the wood stave.

12. The method of claim 8, further comprising pressure soaking the wood stave prior to the microwaving step.

* * * * *